United States Patent [19]

Hsieh

[11] 4,425,487

[45] Jan. 10, 1984

[54] UNITIZED MANUAL ACTUATOR ASSEMBLY FOR UNITIZED ELECTRICAL SWITCH

[75] Inventor: Shao-Chung Hsieh, Warren, Ohio

[73] Assignee: General Motors Corporation, Detroit, Mich.

[21] Appl. No.: 418,716

[22] Filed: Sep. 16, 1982

[51] Int. Cl.[3] ..... H01H 21/84; H01H 21/24

[52] U.S. Cl. ..... 200/153 K; 200/17 R; 200/292; 200/330; 200/335

[58] Field of Search ..... 200/292, 302, 304, 330, 200/332, 335, 339, 153 G, 16 R, 16 A, 16 L, 17 R, 18, 153 K

[56] References Cited

U.S. PATENT DOCUMENTS

| | | | |
|---|---|---|---|
| 2,336,425 | 12/1943 | Shenton | 200/330 |
| 2,791,647 | 5/1957 | Newcomb | 200/153 K |
| 3,501,607 | 3/1970 | Tanaka | 200/153 K |
| 4,029,925 | 6/1977 | Biske | 200/339 |
| 4,045,650 | 8/1977 | Nestor | 200/153 K |
| 4,107,499 | 8/1978 | Weidler | 200/292 |
| 4,124,787 | 11/1978 | Aamoth et al. | 200/17 R |

FOREIGN PATENT DOCUMENTS

| | | | |
|---|---|---|---|
| 1138448 | 10/1962 | Fed. Rep. of Germany | 200/330 |
| 2235330 | 2/1973 | Fed. Rep. of Germany | 200/330 |
| 2478772 | 9/1981 | France | 200/330 |

*Primary Examiner*—John W. Shepperd
*Attorney, Agent, or Firm*—F. J. Fodale

[57] ABSTRACT

A unitized manual actuator assembly is attached to a printed circuit board for operating poppet switches mounted thereon. The actuator assembly comprises a two-piece housing having a pair of integral tube guides disposed in the housing. A pin is slideably disposed in each tube guide with one end protruding out of the housing for operating the switches. The internal end of each pin has an integral hollow cap covering and protecting the upper open end of its associated tube guide. A coil spring surrounds each tube guide and engages the integral hollow cap of the pin to bias it against a rocker member pivotally mounted in the housing. The rocker member has an operator portion extending through an opening in the housing and a pair of oppositely extending arms engaged by the hollow caps so that the pins translate in opposite directions when the rocker member is pivoted.

2 Claims, 3 Drawing Figures

UNITIZED MANUAL ACTUATOR ASSEMBLY FOR UNITIZED ELECTRICAL SWITCH

This invention relates generally to manually operable electrical switches and, more particularly, to a unitized manual actuator assembly for operating a unitized electrical switch on a printed circuit board or the like.

U.S. Pat. No. 4,045,650 granted to Charles R. Nestor on Aug. 30, 1977 shows a current switching device 10 characterized by separately unitized manual actuator and switch assemblies. The manual actuator assembly comprises a three-piece housing and a rocker member 22 pivotally attached to a face plate 12 forming part of the housing. The housing also consists of an intermediate three sided wall 44, 46 and 48 and a base member 70 which forms a side opening 52 when attached to the face plate 12.

The switch assembly itself comprises a rubber pad 72, a printed circuit board portion 56, a foam pad 74 and a contact plate 80. These elements are disposed in a sandwiched relationship and inserted into the actuator housing as a unit through the side opening 52. The switch elements are locked in the housing by a retainer 94 which also serves as the pivot for the contact plate 80.

Current switching devices of the type disclosed in the Nestor patent are often used in automotive applications, particularly in passenger compartments, where liquids and other things can be spilled onto the actuator housing.

In such an event, it is possible for the spilled liquid or other material to pass between the Nestor face plate 12 and rocker member 22 and fall onto the switch mechanism and the circuit board eventually causing operational problems.

The Nestor rocker member 22 is also freely pivotal in the actuator assembly and, consequently, the Nestor actuator assembly is limited to use with types of switch assemblies that provide a biasing force for locating the rocker member in an operative position, such as neutral.

The object of this invention is to provide a unitized manual actuator assembly which prevents spillage from falling through the housing onto the switch mechanism or the printed circuit board on which it is mounted.

Another object of this invention is to provide a unitized manual actuator assembly having a rocker that is biased to an operative position whereby increasing the variety of switches that may be operated by actuator assembly.

Other objects and features of the invention will become apparent to those skilled in the art as the disclosure is made in the following detailed description of a preferred embodiment of the invention as illustrated in the accompanying sheet of drawing in which.

Figure 1:
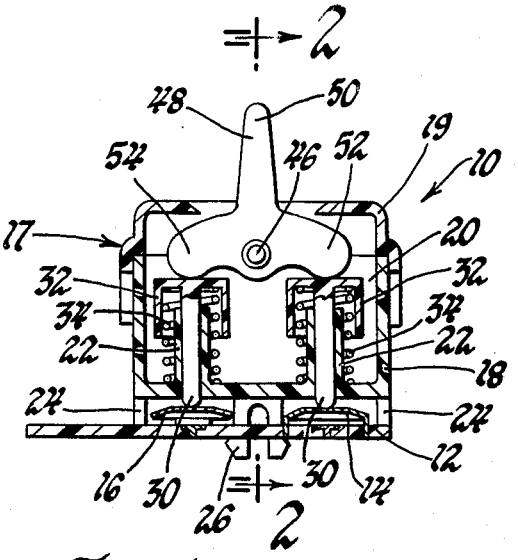
FIG. 1 is a side sectional view of a unitized manual actuator assembly in accordance with this invention.
Figure 2:
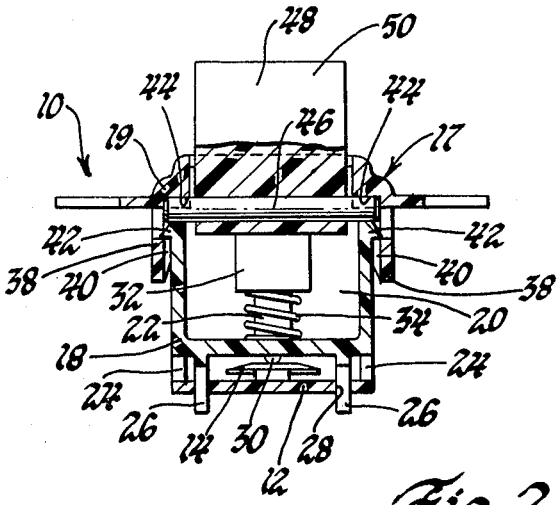
FIG. 2 is a sectional view of the unitized manual actuator assembly taken along the line 2—2 of FIG. 1 and looking in the direction of the arrows.
Figure 3:
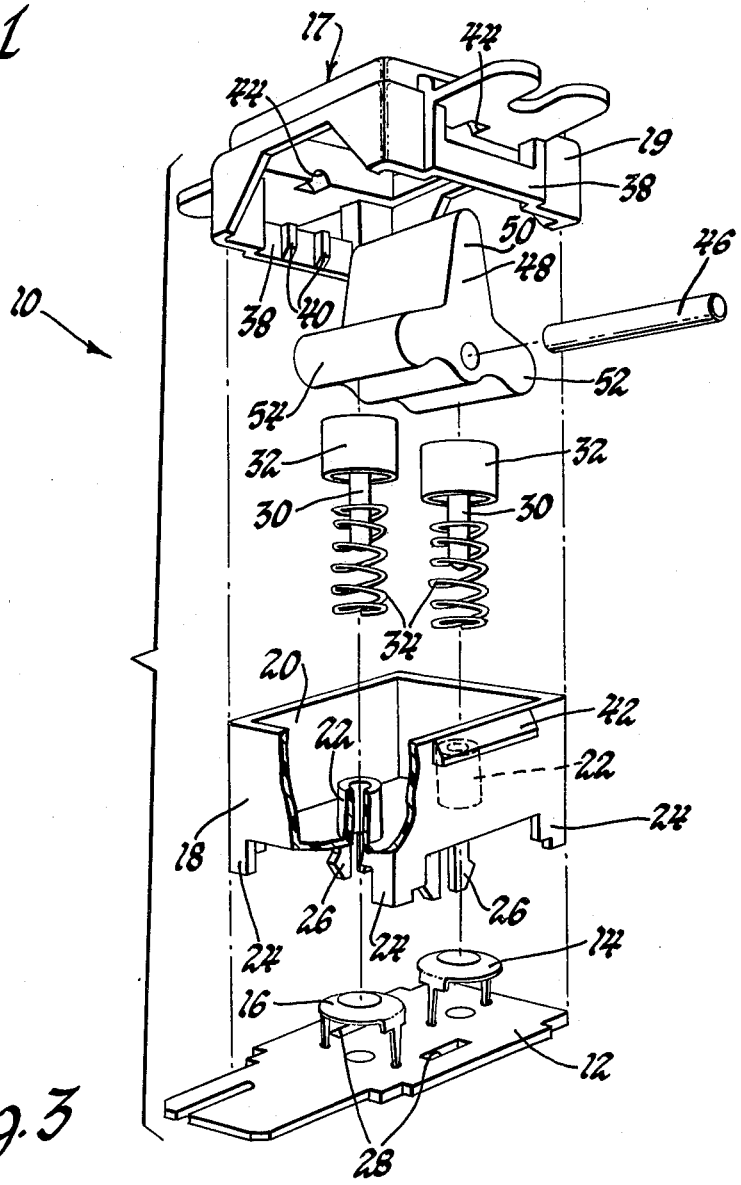
FIG. 3 is an exploded perspective view of the unitized manual actuator assembly shown in FIGS. 1 and 2.

Referring now to the drawing, a unitized manual actuator assembly 10 is shown attached to a printed circuit board 12 for operating a pair of poppet switches 14,16 carried by the printed circuit board 12.

The unitized manual actuator assembly 10 has a housing 17 comprising a base member 18 and a cover member 19. The base member 18 has an internal chamber 20 and a pair of integral tube guides 22 which extend up into the chamber 20 from the bottom wall of the base member 18.

The base member 18 has four corner pedestals 24 and two depending resilient bifurcated catches 26. The pedestals 24 rest on the printed circuit board 12 to provide space for the poppet switches 14 and 16 beneath the bottom wall when the housing 17 is attached to the printed circuit board 12 by the bifurcated catches 26 being snapped through slots 28 in the printed circuit board 12.

The actuator assembly 10 has a pair of pins 30 slideably disposed in the respective tube guides 22. Each pin 30 has an enlarged hollow cap 32 which surrounds and protects the upper end of its associated tube guide 22 against foreign material entering the upper opening of the tube guide 22. Each tube guide 22 is surrounded by a coil spring 34 which fits inside the hollow cap 32 at its upper end.

The cover member 19 fits over the upper end of the base member 18 and has flexible side wall portions 38 which have internal lock nibs 40. These lock nibs 40 cooperate with laterally extending lips 42 on the upper end of the base member 18 to lock the cover member 19 in place.

Two upper journal halves 44 are molded in the cover member 19 for receiving the opposite ends of a pivot pin 46 which extends through a rocker member 48. When the cover member 19 is locked in place, the pivot pin 46 rests on the upper edge of the base member 18 and the rocker member 48 is pivotally mounted in the housing. The rocker member 48 has an operator portion 50 which extends through an opening in the cover member 19 and a pair of oppositely extending arms 52,54 which engage the respective hollow caps 32 so that the spring biased pins 30 translate in opposite directions when the rocker 48 is pivoted.

FIG. 1 shows the neutral position of the rocker member 48 with both poppet switches open. When the operator portion 50 is pivoted clockwise, arm 52 pushes the right-hand pin 30 downward against the bias of its spring 34 to close poppet switch 14. At the same time, the left-hand pin 30 is raised under the bias of its spring 34. Poppet switch 16 is closed and poppet switch 14 opened by pivoting the operator portion 50 counterclockwise past the neutral position.

It should be noted that the unitized manual actuator assembly 10 has a rocker member 48 which is biased to a neutral position by the coil springs 34 and, consequently, the assembly 10 can be used in conjunction with a great variety of switches. It should also be noted that the switches 14,16 and the printed circuit board 12 are protected by the integral tube guides 22 and enlarged hollow caps 32 of the pins 30 in the event spillage onto the cover member 19 leaks into the housing 17 through the opening in the cover member 19. I wish it to be understood that I do not desire to be limited to the exact details of construction shown and described, for obvious modifications will occur to a person skilled in the art.

The embodiments of the invention in which an exclusive property or privilege is claimed are defined as follows:

1. A unitized manual actuator assembly for printed circuit board switches and the like comprising:

a base member having a chamber and a pair of integral tube guides disposed in the chamber, each of said tube guides having an upper open end disposed in the chamber, and a lower open end outside of the chamber, a pin slideably disposed in each tube guide, each said pin having an integral hollow cap at one end covering the inner open end of its associated tube guide and an opposite end protruding out of the lower open end of the associated tube guide, a coil spring surrounding each tube guide and engaging the integral hollow cap of the pin slideably disposed in the associated tube guide, a cover member attached to the base member to form a housing, a rocker member pivotally mounted in the housing, said rocker member having an operator portion extending through an opening in the cover member and a pair of oppositely extending arms in the housing which engage respective ones of the integral hollow caps so that the pins translate in opposite directions when the rocker is pivoted, and means on the base member for attaching the unitized manual actuator assembly to a printed circuit board or the like.

2. A unitized manual actuator assembly for printed circuit board switches and the like comprising:

a base member having a chamber and a pair of integral tube guides disposed in the chamber, each of said tube guides having an upper open end disposed in the chamber, and a lower open end outside of the chamber, a pin slideably disposed in each tube guide, each said pin having an integral hollow cap at one end covering the inner open end of its associated tube guide and an opposite end protruding out of the lower open end of the associated tube guide, a coil spring surrounding each tube guide and having an upper end disposed inside the integral hollow cap of the pin slideably disposed in the associated tube guide, a cover member attached to the base member to form a housing, a rocker member pivotally mounted in the housing by means of a pivot pin having its opposite ends disposed in journal portions of the cover member and resting on an upper edge of the base member, said rocker member having an operator portion extending through an opening in the cover member and a pair of oppositely extending arms in the housing, said arms being engaged by respective ones of the integral hollow caps under the bias of the coil springs so that the pins translate in opposite directions when the rocker member is pivoted, and means on the base member for attaching the unitized manual actuator assembly to a printed circuit board or the like.

* * * * *